US011085684B2

(12) United States Patent
Sibik

(10) Patent No.: US 11,085,684 B2
(45) Date of Patent: Aug. 10, 2021

(54) SYSTEM AND METHOD FOR UNLOADING A MULTI-STAGE COMPRESSOR

(71) Applicant: TRANE INTERNATIONAL INC., Davidson, NC (US)

(72) Inventor: Lee L. Sibik, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 118 days.

(21) Appl. No.: 16/454,317

(22) Filed: Jun. 27, 2019

(65) Prior Publication Data

US 2020/0408448 A1 Dec. 31, 2020

(51) Int. Cl.
*F25B 49/02* (2006.01)
*F25B 41/20* (2021.01)
*F25B 1/10* (2006.01)

(52) U.S. Cl.
CPC ..... *F25B 49/022* (2013.01); *F25B 1/10* (2013.01); *F25B 41/20* (2021.01); *F25B 2400/077* (2013.01)

(58) Field of Classification Search
CPC ..... F25B 49/022; F25B 41/04; F25B 1/10; F25B 2400/077
USPC ..... 62/510
See application file for complete search history.

(56) References Cited

U.S. PATENT DOCUMENTS 2,897,659 A * 8/1959 Frantisek ..... F25B 1/053 62/509
3,226,940 A * 1/1966 Jekat ..... F25B 1/053 62/199
3,390,545 A 7/1968 Hoffman
3,461,685 A 4/1969 Hoffman et al.
4,938,029 A 7/1990 Shaw
2015/0128640 A1 5/2015 Sun et al.
2016/0272047 A1 9/2016 Gan
2019/0285072 A1 9/2019 Masutani et al.

FOREIGN PATENT DOCUMENTS

EP 2417406 3/2019
WO 2018/151293 A1 8/2018

OTHER PUBLICATIONS

Extended European Search Report, European Patent Application No. 20182442.2, dated Oct. 26, 2020 (7 pages).

* cited by examiner

*Primary Examiner* — Steve S Tanenbaum
(74) *Attorney, Agent, or Firm* — Hamre, Schumann, Mueller & Larson, P.C.

(57) ABSTRACT

The unloading of multi-stage compressors may include the introduction of flow from a gas bypass from a condenser into a second-stage inlet duct to induce a swirl in the flow into second stage compression. This unloading may be performed on multi-stage compressors in heating, ventilation, air conditioning and refrigeration (HVACR) circuits that include a gas bypass from a condenser to the second-stage inlet housing of the compressor. The multi-stage compressor may include an impeller inlet duct including a flow straightener receiving fluid flow from the first stage discharge, and one or more channels to introduce gas from the gas bypass into the flow passing through the impeller inlet duct. The flow introduced by the channels may have a direction of flow including a component opposite to the direction of flow of the fluid flow from the first stage discharge via the flow straightener.

14 Claims, 7 Drawing Sheets

SYSTEM AND METHOD FOR UNLOADING A MULTI-STAGE COMPRESSOR

FIELD

This disclosure is directed to the unloading of multi-stage compressors, particularly the introduction of a flow into a second stage of the compressor.

BACKGROUND

In multi-stage compressors, the first stage of the compressor may be unloaded by guide vanes governing the mass flow entering the first stage suction. When the first stage is unloaded without corresponding unloading of the second stage, the second stage will continue to draw flow, causing the inter-stage pressure to drop. The lower pressure at the inlet to the second stage impeller reduces mass flow low enough to balance flows. A common problem with many centrifugal compressor designs is the unloading characteristic is not always stable. The reduction in flow and pressure can lead to instability in inter-stage flow and a phenomenon called rotating stall or stall. This effect can be mistaken for surge, but with stall, there is no flow reversal through the compressor. There will be a cyclic variation in mass flow and pressures, but flow direction never reverses as it does in surge. The overall effect may range from not noticeable to highly objectionable noise and vibration. These effects may be particularly pronounced at higher head conditions.

SUMMARY

This disclosure is directed to the unloading of multi-stage compressors, particularly the introduction of a flow into a second stage of the compressor.

Introduction an additional mass flow into the flow into the second stage can stabilize a multi-stage compressor when the first stage is being unloaded. Further, this mass introduction can be used to introduce a swirl into the flow into the second stage that improves the unloading effectiveness at the second stage. Further, the introduction of the mass flow can be used to adjust the velocity vector of the flow, controlling the head capability and volume of flow into the second stage of the compressor.

In an embodiment, a heating, ventilation, air conditioning and refrigeration (HVACR) system includes a multi-stage compressor including a first stage discharge and a second stage inlet receiving a fluid from the first stage discharge, a condenser, an expansion device, an evaporator, and a bypass line from the condenser to the second stage inlet of the multi-stage compressor. The bypass line includes a valve. When the valve is open, the second stage inlet receives a fluid flow. The second stage inlet is configured to direct the fluid flow to join the fluid from the first stage discharge such that a swirl is formed in a combined fluid flow.

In an embodiment, the swirl is in a direction that is the same as a direction of rotation of an impeller in the multi-stage compressor.

In an embodiment, the second stage inlet is further configured to direct the fluid flow in a direction having a component opposite a direction of flow of the fluid from the first stage discharge. The component is a component of a vector of the direction of the fluid flow.

In an embodiment, the valve is a variable flow rate valve. In an embodiment, the valve is opened when the multi-stage compressor is unloaded.

In an embodiment, the second stage inlet does not include movable guide vanes.

In an embodiment, the multi-stage compressor further comprises a first stage suction and a plurality of movable guide vanes at the first stage suction, wherein the plurality of movable guide vanes control a mass flow rate into the multi-stage compressor.

In an embodiment, an inlet duct for a multi-stage compressor includes an inlet opening configured to receive a first fluid flow from a first stage of the multi-stage compressor, and a plurality of channels configured to receive a second fluid flow from a bypass line and introduce the second fluid flow into the first fluid flow such that a swirl is formed in the first fluid flow.

In an embodiment, the swirl is in a direction that is the same as a direction of rotation of an impeller in the multi-stage compressor.

In an embodiment, the channels are configured to introduce the second fluid flow into the first fluid flow in a direction having a component opposite a direction of the first fluid flow.

In an embodiment, the channels are configured to introduce the second fluid flow into the first fluid flow in a direction having a component in a same direction as a direction of the first fluid flow.

In an embodiment, the channels are through holes drilled from an exterior surface of the inlet duct to an interior space of the inlet duct, and wherein the interior space of the inlet duct receives the first fluid flow from the first stage of the multi-stage compressor via the inlet opening.

In an embodiment, a method for unloading a multi-stage compressor in a heating, ventilation, air conditioning, and refrigeration system includes receiving a first fluid flow from a first stage discharge of the multi-stage compressor at a second-stage inlet of the multi-stage compressor, opening a bypass valve in a bypass line, the bypass line connecting a condenser to the second-stage inlet, and directing a second fluid flow from the bypass line to join the first fluid flow through one or more channels in a duct of the second-stage inlet, such that a combined fluid flow has a swirl.

In an embodiment, the swirl is in a direction that is the same as a direction of rotation of an impeller in the multi-stage compressor.

In an embodiment, the second fluid flow travels in a direction having a component opposite a direction of the first fluid flow when the second fluid flow is directed to join the first fluid flow.

In an embodiment, the second fluid flow travels in a direction having a component in a direction that is the same as a direction of the first fluid flow when the second fluid flow is directed to join the first fluid flow.

In an embodiment, the method further includes reducing a flow rate into a first stage of the multi-stage compressor using a plurality of movable guide vanes.

DRAWINGS

DETAILED DESCRIPTION

This disclosure is directed to the unloading of multi-stage compressors, particularly the introduction of a flow into a second stage of the compressor.

Figure 1:
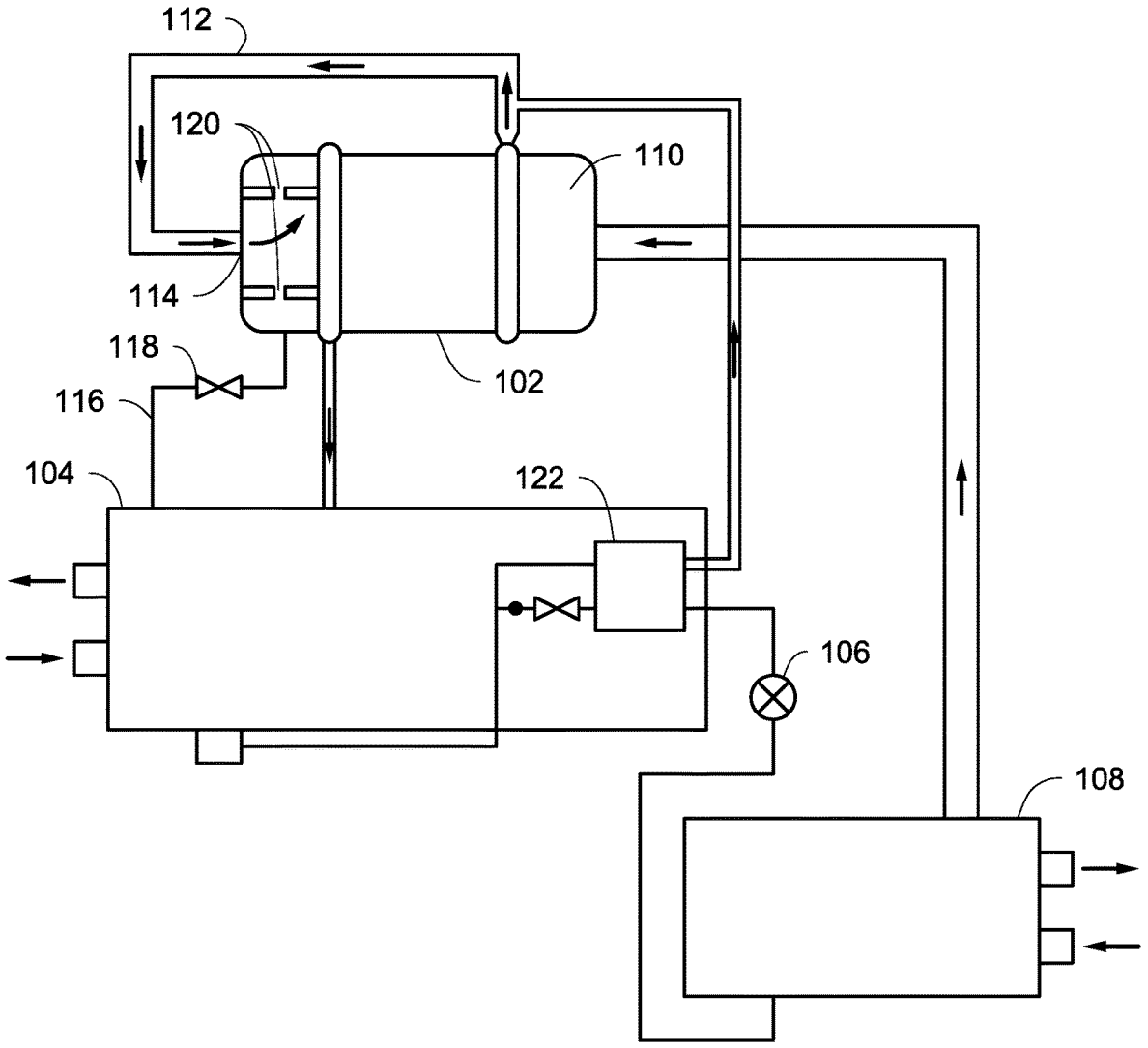
FIG. 1 is a schematic of a heating, ventilation, air conditioning and refrigeration (HVACR) circuit according to an embodiment.

FIG. 1 shows a schematic of a heating, ventilation, air conditioning and refrigeration (HVACR) circuit 100 according to an embodiment.

HVACR circuit 100 includes compressor 102, condenser 104, expansion device 106, and an evaporator 108.

The compressor 102, the condenser 104, the expansion device 106, and the evaporator 108 may be fluidly connected to form the HVACR circuit 100. The HVACR circuit 100 can alternatively be configured to heat or cool a gaseous process fluid (e.g., a heat transfer medium or fluid such as, but not limited to, air or the like), in which case the HVACR circuit 100 may be generally representative of an air conditioner or a heat pump.

Compressor 102 compresses a working fluid (e.g., a heat transfer fluid such as a refrigerant or the like) from a relatively lower pressure gas to a relatively higher pressure gas. The relatively higher pressure gas is also at a relatively higher temperature, which is discharged from the compressor 102 and flows through the condenser 104. Compressor 102 is a multi-stage compressor. Compressor 102 includes first stage suction 110. Compressor 102 further includes line 112 connecting the first stage to the second stage inlet 114. Line 112 may be, for example, a pipe. In compressor 102, the working fluid is received at the first stage suction 110, compressed a first time, then discharged from the first stage to the line 112. The working fluid compressed by the first stage is then received at the second stage inlet 114, and compressed a second time, then discharged to condenser 104.

Condenser 104 may be fluidly connected to gas bypass line 116. Gas bypass line 116 receives hot gas from within condenser 104 and conveys the hot gas from condenser 104 to the second stage inlet 114 of the compressor 102.

Gas bypass line 116 may include a valve 118. Valve 118 regulates flow through the gas bypass line 116. In an embodiment, valve 118 is a valve having an open position and a closed position. In an embodiment, valve 118 is a variable flow rate valve, such as a valve having multiple discrete flow rates or a continuously variable flow rate. Valve 118 may be controlled according to the unloading of the first stage of compressor 102, for example increasing flow through gas bypass line 116 when unloading the first stage of the compressor 102.

Figure 2:
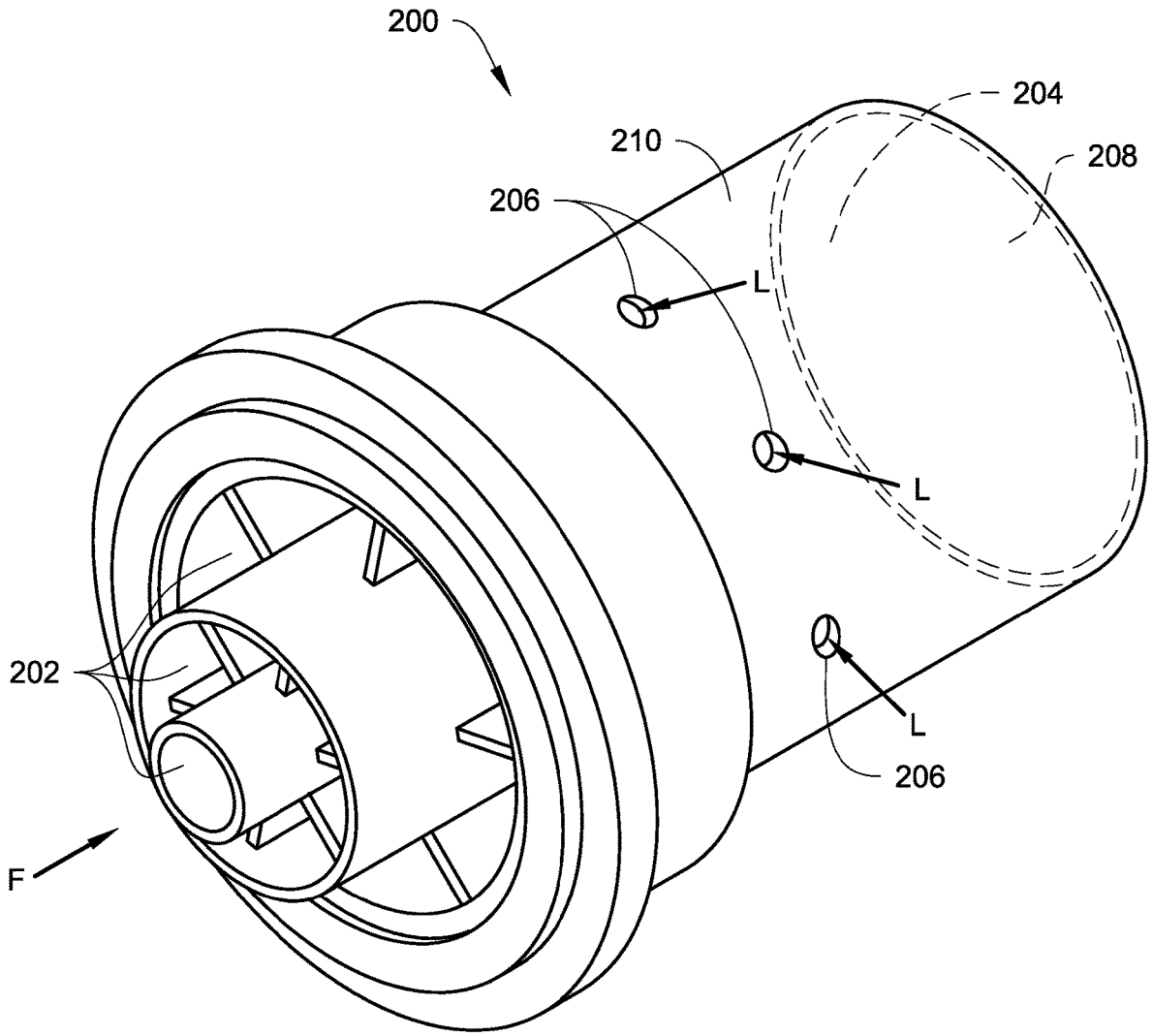
FIG. 2 is a perspective view of an impeller duct according to an embodiment.

Channels 120 allow a bypass flow of fluid from the gas bypass line 116 to join the first stage discharge flow from line 112 in second stage inlet 114 and enter the second stage of compressor 102. The channels 120 are oriented such that a swirl is induced into the combined flow of the first stage discharge flow from line 112 and the bypass flow from channels 120. In an embodiment, the swirl is in a direction that is the same as a direction of rotation of a rotating component within the second stage of compressor 102. In an embodiment, the combined flow may be a mass flow having a velocity that is less than the velocity of the first stage discharge flow when it is received from line 112. An example embodiment of channels 120 is shown in FIG. 2 and discussed below.

HVACR circuit 100 further includes expansion device 106. Expansion device 106 is a device configured to reduce the pressure of the working fluid. As a result, a portion of the working fluid is converted to a gaseous form. Expansion device 106 may be, for example, an expansion valve, orifice, or other suitable expander to reduce pressure of a refrigerant such as the working fluid.

Evaporator 108 is an evaporator where the working fluid absorbs heat from a process fluid (e.g., water, glycol, air, or the like), heating the working fluid. This at least partially evaporates the working fluid. The working fluid then flows from evaporator 108 to the first stage suction 110 of compressor 102. The circulation of the working fluid through HVACR circuit 100 continues while the refrigerant circuit is operating, for example, in a cooling mode (e.g., while the compressor 102 is enabled).

HVACR system 100 may further include an economizer 122. Economizer 122 may direct some working fluid from at or near the condenser into line 112 conveying fluid to the second stage inlet 114. Economizer 122 may be any standard economizer included in HVACR circuits. In an embodiment, economizer 122 includes a brazed plate heat exchanger.

FIG. 2 shows a perspective view of an impeller inlet duct 200 according to an embodiment. Impeller inlet duct 200 may be located at an intake of a second stage of a multi-stage compressor, such as second stage inlet 114 of compressor 102 shown in FIG. 1. Impeller inlet duct includes flow straightener 202, an internal space 204 defined by outer wall 210, a plurality of channels 206, and outlet 208.

Flow straightener 202 receives a fluid flow and is configured to smooth and straighten the received fluid flow. Flow straightener 202 may include multiple concentric circular openings, connected by a plurality of vanes to define a plurality of openings. Flow straightener 202 may direct fluid flow entering the flow straightener 202 through to internal space 204 of the inlet impeller duct 200. The flow straightener 202 may be connected to a fluid line such as line 112 shown in FIG. 1 and described above that conveys a flow from the first stage discharge of a multi-stage compressor to the flow straightener 202. In an embodiment, the fluid line may further receive fluid from an economizer such as economizer 122 shown in FIG. 1 and described above.

Internal space 204 is a hollow space within the impeller inlet duct 200. Internal space 204 may be defined by outer wall 210 of the impeller inlet duct. Internal space 204 may receive fluid flow from flow straightener 202 and from channels 206. The fluid flow from flow straightener 202 and from channels 206 may be combined and mixed within the internal space 204. The internal space 204 may continue to outlet 208, which allows fluid flow from the internal space 204 to the second stage compression of the multi-stage compressor.

Channels 206 are one or more channels by which fluid flows may be introduced into internal space 204. In an embodiment, channels 206 are straight-drilled through holes in the outer wall 210 of the impeller inlet duct 200. Non-limiting examples of channels 206 include holes, slots, or nozzles. Channels 206 may be provided in one or more rows. The channels are oriented such that fluid flow entering the internal space 204 through the channels 206 introduces a swirl into a fluid flow passing from flow straightener 202 through internal space 204 to outlet 208. The number of channels may be varied based on, for example, the size of the channels 206 and flow rates through the channels 206, the orientation of the channels with respect to internal space 204, and the properties of the compressor including impeller inlet duct 200. In an embodiment, the channels 206 are oriented such that the direction L of flow through the channels 206 into internal space 204 includes a component that is tangential to the direction F of the fluid flow from flow straightener 202. The tangential component may induce the swirl in the combined flow within internal space 204.

In an embodiment, the channels 206 are further oriented such that the direction L of flow through the channels 206 into the internal space 204 includes a component opposite to the direction F of the fluid flow from flow straightener 202. This velocity component reduces the velocity of the fluid flow in direction F as it passes through internal space 204. Reducing the velocity of flow may assist unloading, for example by reducing the volume of flow into the second stage compression. In an embodiment, the channels are oriented such that the direction L of flow through the channels 206 into the internal space 204 includes a component that is in the same direction as the direction F of the fluid flow from flow straightener 202. In this embodiment, head pressure may be boosted by the component of fluid flow through channels 206 that is in the same direction as the direction F of the fluid flow from flow straightener 202.

Outlet 208 allows the fluid from internal space 204, including fluid received at flow straightener 202 and fluid received via channels 206, to continue through the second stage of the compressor to be compressed.

Figure 3:
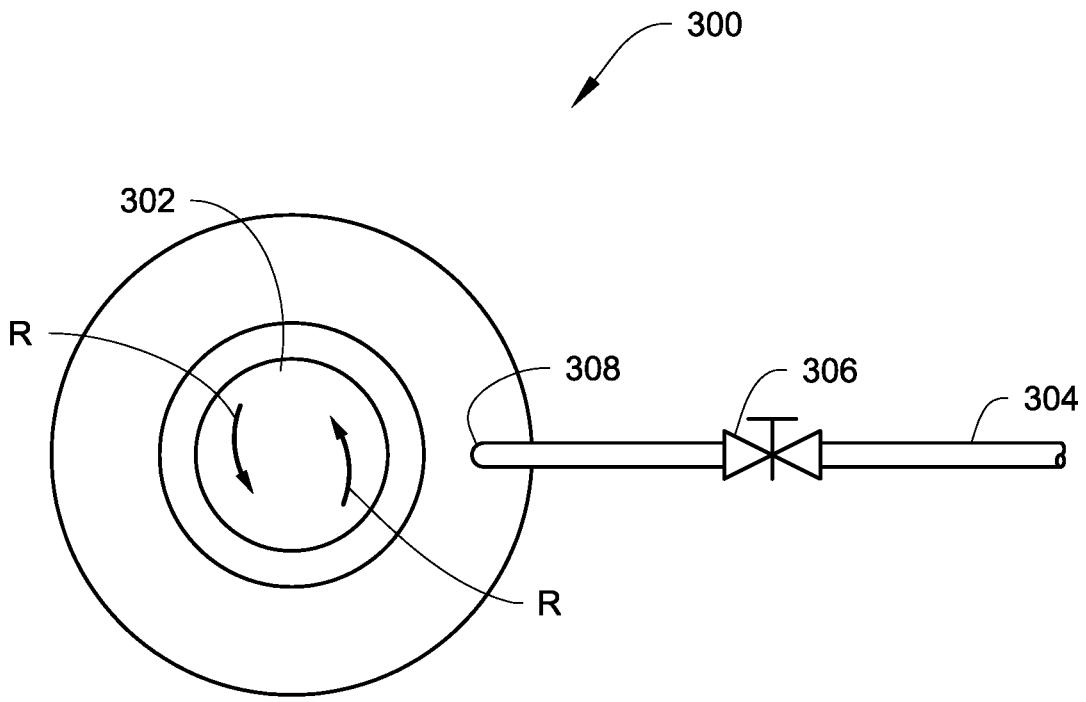
FIG. 3 is a schematic view of an inlet housing according to an embodiment.

FIG. 3 is a schematic view of an inlet housing 300 of a compressor according to an embodiment. Inlet housing 300 may surround an impeller inlet duct such as impeller inlet duct 200 shown in FIG. 2 and described above. Inlet housing 300 may include second stage intake aperture 302 and bypass intake aperture 308. Inlet housing 300 may be installed in a compressor having a direction of rotation R as shown in FIG. 3.

Second stage intake aperture 302 is an aperture to which a fluid line from a first stage discharge of the multi-stage compressor may be connected. The fluid line may be, for example, line 112 shown in FIG. 1 and described above. The second stage intake aperture may provide fluid communication between the fluid line from the first stage discharge and a flow straightener of an inlet impeller duct, such as flow straighter 202 of inlet impeller duct 200 shown in FIG. 2 and described above.

Bypass intake aperture 308 may receive fluid from a gas bypass from a condenser of an HVACR circuit such as condenser 104 of HVACR circuit 100 shown in FIG. 1 and described above. The gas from the gas bypass may be conveyed to the bypass intake 308 by gas bypass line 304. In an embodiment, bypass gas may be sourced to gas bypass line 304 from compressor discharge of the compressor including inlet housing 300. Flow through gas bypass line 304 may be controlled by valve 306. In an embodiment, valve 306 is a valve having an open position and a closed position. In an embodiment, valve 306 is a variable flow rate valve, such as a valve having multiple discrete flow rates or a continuously variable flow rate. Valve 306 may be controlled according to the unloading of the first stage of a compressor including inlet housing 300, for example increasing flow through gas bypass line 304 when the first stage of the compressor is unloaded. In an embodiment, valve 306 may be controlled in response to a measurement of stall occurring in the compressor.

Flow into inlet housing 300 through bypass intake aperture 308 enters a space between the inlet housing and an impeller inlet duct of the compressor, such as the inlet duct 200 shown in FIG. 2 and described above. This space may be separate from the path from second stage intake aperture 302 provides from the fluid line to the flow straightener of the inlet impeller duct. The flow then may proceed through channels, such as channels 206 and 614 shown in FIG. 2 and FIG. 6, respectively, and then the inlet duct, such as inlet duct 200 to impart a swirl into the flow that passes through second stage intake aperture 302 into the second stage of the compressor. The swirl may be in a direction that is the same as direction of rotation R of rotating components of the second stage of the compressor.

Figure 4:
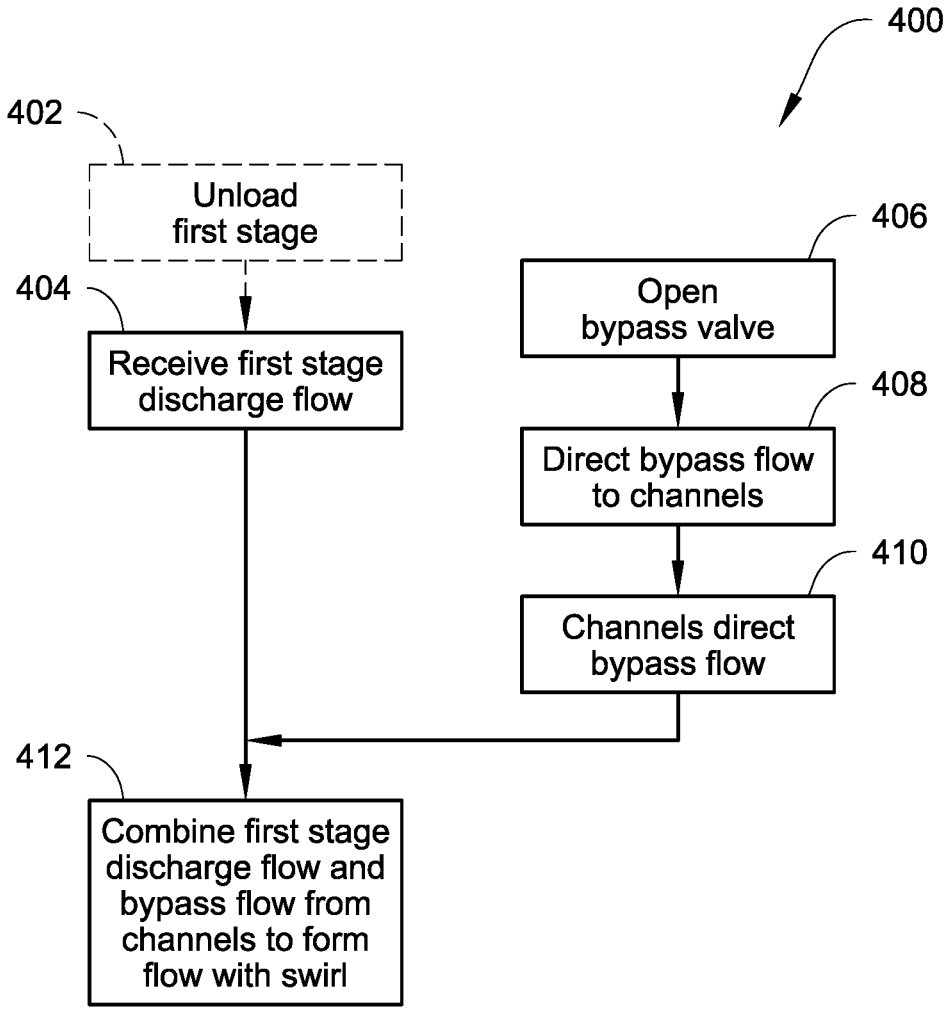
FIG. 4 is a flow chart of a method of unloading a multi-stage compressor according to an embodiment.

FIG. 4 is a flow chart of a method 400 of unloading a multi-stage compressor according to an embodiment. Method 400 optionally includes unloading a first stage of the multi-stage compressor 402. Method 400 includes receiving a first stage discharge flow 404, opening a bypass valve 406, directing a bypass flow to one or more channels 408, directing the bypass flow using the one or more channels 410, and combining the first stage discharge flow and the bypass flow to form a combined flow having a swirl 412.

Method 400 may optionally include unloading a first stage of the multi-stage compressor 402. Unloading the first stage of the compressor at 402 may include using guide vanes to regulate the flow of fluid into the first stage of the compressor, for example by deploying the guide vanes to limit this flow.

Method 400 includes receiving, at the second stage of the multi-stage compressor, a first stage discharge flow. The first stage discharge flow is a flow of fluid that has been compressed by the first stage of the multi-stage compressor. In an embodiment, the first stage of the multi-stage compressor may be operated while unloading the first stage, for example unloading via guide vanes at 402. In an embodiment, the first stage discharge flow may further include fluid from an economizer in the circuit including the multi-stage compressor, such as economizer 122 in FIG. 1 and described above. In an embodiment, the first stage discharge flow is received at a flow straightener of an impeller inlet duct, such as flow straightener 202 of inlet impeller duct 200 shown in FIG. 2 and described above. The flow straightener may condition the first stage discharge flow, such that it flows smoothly in a consistent direction through the inlet impeller duct. The first stage discharge flow received at 404 may continue through the inlet impeller duct into a space within the inlet impeller duct such as internal spaces 204 and 700 shown in FIG. 2 and FIG. 7, respectively.

Method 400 also includes opening a bypass valve 406. The bypass valve opened at 406 may be a valve such as valve 118 shown in FIG. 1 and described above or valve 306 shown in FIG. 3 and described above. The valve may be along a bypass line, such as bypass line 116 or bypass line 304. Opening the bypass valve 406 allows fluid to flow through the bypass valve. In an embodiment, opening the bypass valve includes moving the bypass valve from a closed position to an open position. In an embodiment, opening the bypass valve includes increasing an amount of fluid flow through the bypass valve, where the bypass valve is a variable flow rate valve, such as a valve having multiple discrete flow rates or a continuously variable flow rate. In an embodiment, the extent of opening the bypass valve at 406 may be based on the extent of unloading of the multi-stage compressor, such as increasing the fluid flow by a larger amount when the unloading of the compressor is at a higher value and/or when stalling or instability in compressor flow is detected or determined to be occurring.

When the bypass valve is opened at 406, a bypass flow is directed from the bypass valve to one or more channels 408. The bypass flow may be directed to the one or more channels by, for example, a portion of the bypass line downstream of the bypass valve, and/or by a housing around an impeller inlet duct that receives the bypass flow. The housing and impeller inlet duct together may provide a space between the housing and impeller inlet duct that allows fluid within the space to reach and enter openings of channels through the impeller duct, such as channels 120 shown in FIG. 1 and described above or channels 206 and 614 shown in FIG. 2 and FIG. 6, respectively.

Figure 5A:
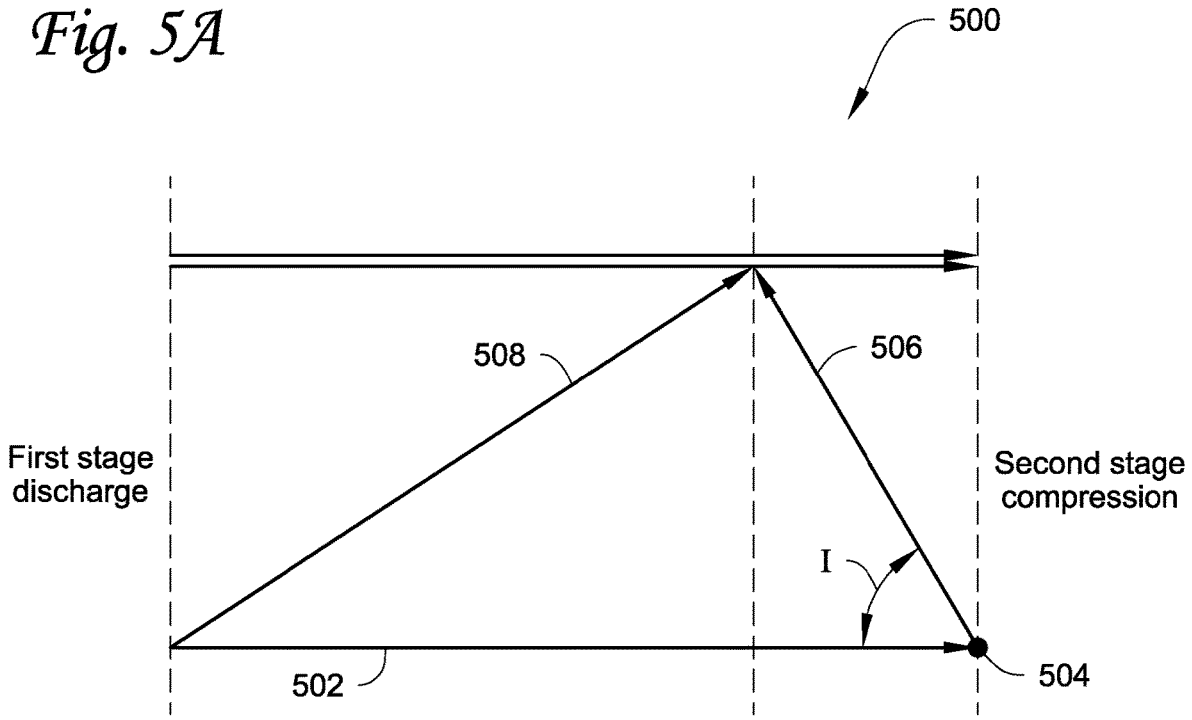
FIG. 5A is a diagram of the velocity vectors of the flow from the first stage discharge and the bypass flow within an impeller duct in a multi-stage compressor according to an embodiment.
Figure 5B:
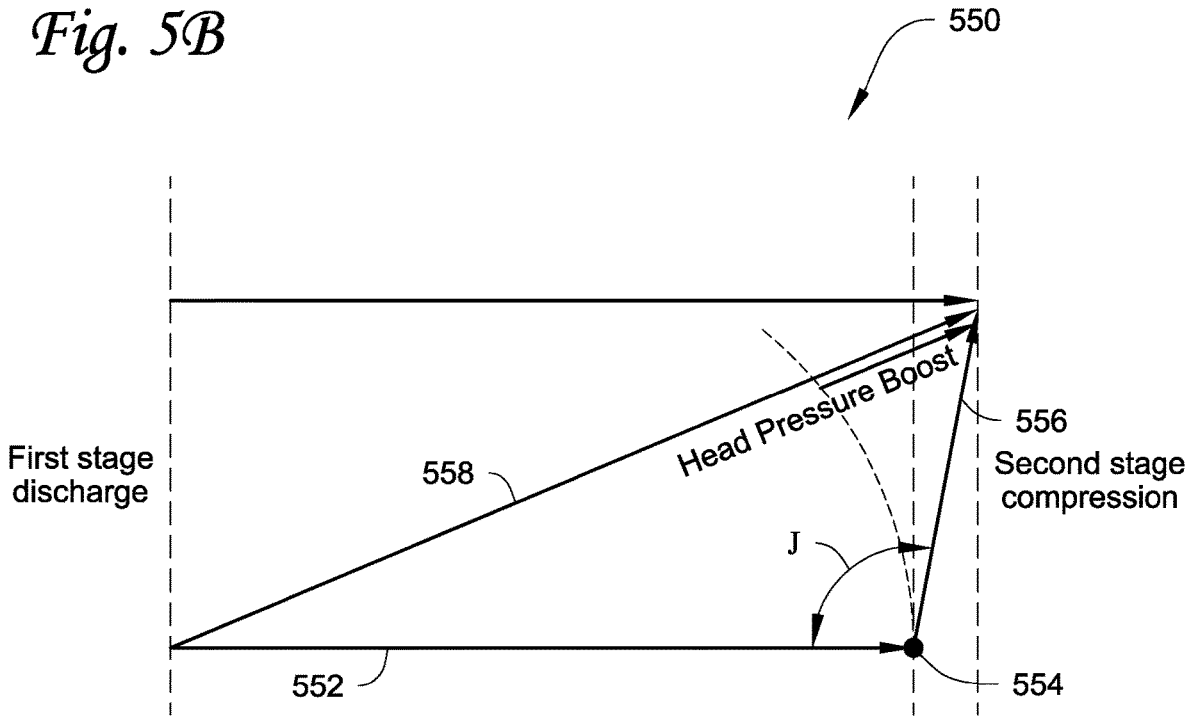
FIG. 5B is a diagram of the velocity vectors of the flow from the first stage discharge and the bypass flow within an impeller duct in a multi-stage compressor according to another embodiment.

At the one or more channels, the bypass flow is directed at 410. At 410, the bypass flow is directed towards the first stage discharge flow received at 404 within an internal space of the impeller duct, such as internal space 204 shown in FIG. 2 and described above. The flow is directed via channels formed in the impeller duct. The channels may orient the direction of flow into the internal space of the impeller duct such that flow into the impeller duct enters the internal space at a position and angle that induces a swirl when combined with the first stage discharge flow received at 404. In an embodiment, the channels further orient the direction of the bypass flow into the internal space such that the bypass flow is introduced at an injection angle I as shown in FIG. 5A or an injection angle J as shown in FIG. 5B. In this embodiment, a vector representing the direction of the bypass flow includes a component in a direction opposite the direction of the first stage discharge flow that is received at 404.

The bypass flow directed by the one or more channels at 410 and the first stage discharge flow received from the first stage of the compressor at 404 are combined to form a flow having a swirl at 412. The respective directions of each of the bypass and first stage discharge flows results in a combined flow having a swirl due to the directions of the flow directed by the one or more channels. In an embodiment, the swirl is in a direction that is the same as a direction of rotation of at least one rotating part of the second stage compression of the multi-stage compressor. In an embodiment, the combination of flows also has a linear velocity that is less than the linear velocity of the flow received from the first stage of the compressor at 404. This combined flow may then enter second stage compression in the multi-stage compressor, where it is compressed and discharged from the multi-stage compressor.

FIG. 5A is a diagram 500 of the velocity vectors of the flow from the first stage discharge and the bypass flow within an impeller duct in a multi-stage compressor according to an embodiment. The velocity vectors represent the velocities of fluid flows within a second-stage impeller duct according to an embodiment during unloading of the compressor, such as impeller duct 200 shown in FIG. 2 and described above.

First stage discharge flow velocity vector 502 represents the velocity of fluid flow received from the first stage discharge of a multi-stage compressor. The first stage discharge flow is the flow received by the second stage at an impeller duct such as impeller duct 200. The flow may have a consistent direction provided by travelling through a flow straightener such as flow straightener 202. The flow travels in a direction from the entry into the impeller duct from the first stage discharge towards second stage compression in the multi-stage compressor.

A gas bypass flow is provided at entry point 504. Entry point 504 is, for example, an opening where a channel such as channel 120 shown in FIG. 1 and described above or channel 206 that introduce fluid flow from a gas bypass to a fluid flow within the inlet duct. The gas bypass flow has a velocity represented by gas bypass flow velocity vector 506.

The gas bypass flow may be provided at an injection angle I with respect to first stage discharge flow velocity vector 502. In an embodiment, the injection angle I is 90 degrees. In an embodiment, the injection angle I is an acute angle. When injection angle I is an acute angle, a component of the gas bypass flow velocity opposes the first stage discharge flow velocity, thus reducing the total velocity of the fluid flow entering the second stage compression of the multi-stage compressor.

The total velocity of the combined first stage discharge flow and the gas bypass flow is represented by total velocity vector 508. Total velocity vector 508 includes a swirl in a direction. In an embodiment, the swirl is in a direction corresponding to a direction of rotation of a component in the second stage compression of the multi-stage compressor. In an embodiment, the velocity represented by total velocity vector 508 has a velocity that is reduced in comparison with the first stage discharge flow. The combined first stage discharge flow and the gas bypass flow travels into the second stage compression of the multi-stage compressor with the velocity represented by total velocity vector 508.

FIG. 5B is a diagram 550 of the velocity vectors of the flow from the first stage discharge and the bypass flow within an impeller duct in a multi-stage compressor according to an embodiment. The velocity vectors represent the velocities of fluid flows within a second-stage impeller duct according to an embodiment during unloading of the compressor, such as impeller duct 200 shown in FIG. 2 and described above.

First stage discharge flow velocity vector 552 represents the velocity of fluid flow received from the first stage discharge of a multi-stage compressor. The first stage discharge flow is the flow received by the second stage at an impeller duct such as impeller duct 200. The flow may have a consistent direction provided by travelling through a flow straightener such as flow straightener 202. The flow travels in a direction from the entry into the impeller duct from the first stage discharge towards second stage compression in the multi-stage compressor.

A gas bypass flow is provided at entry point 554. Entry point 554 is, for example, an opening where a channel such as channel 120 shown in FIG. 1 and described above or channel 206 that introduce fluid flow from a gas bypass to a fluid flow within the inlet duct. The gas bypass flow has a velocity represented by gas bypass flow velocity vector 556.

The gas bypass flow may be provided at an injection angle J with respect to first stage discharge flow velocity vector 552. In the embodiment shown in FIG. 5B, the injection angle J is an obtuse angle. When injection angle J is an acute angle, a component of the gas bypass flow velocity is in the same direction as the first stage discharge flow velocity, thus increasing the total velocity of the fluid flow entering the second stage compression of the multi-stage compressor. This may provide a boost to head pressure for the second stage of the compressor.

The total velocity of the combined first stage discharge flow and the gas bypass flow is represented by total velocity vector 558. Total velocity vector 558 includes a swirl in a direction. In an embodiment, the swirl is in a direction corresponding to a direction of rotation of a component in the second stage compression of the multi-stage compressor.

In an embodiment, the velocity represented by total velocity vector 558 has a velocity that is reduced in comparison with the first stage discharge flow. The combined first stage discharge flow and the gas bypass flow travels into the second stage compression of the multi-stage compressor with the velocity represented by total velocity vector 558.

Figure 6:
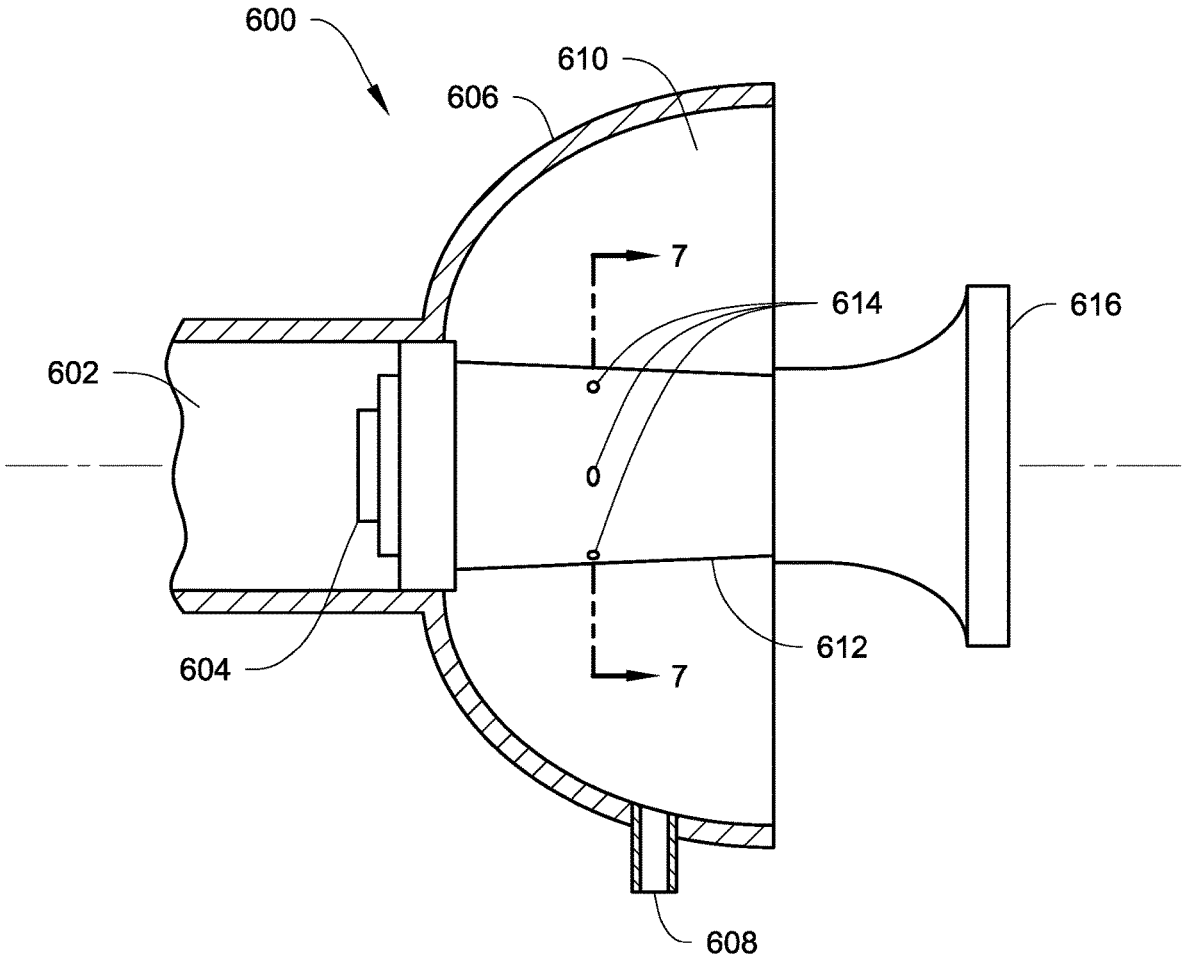
FIG. 6 is a sectional view of an impeller duct and an inlet housing assembled together according to an embodiment.

FIG. 6 is a sectional view of an impeller duct and an inlet housing assembled together 600 according to an embodiment. The assembled impeller duct and inlet housing 600 receives fluid flow from a prior stage of a multi-stage compressor at stage inlet 602, and directs this fluid flow to impeller 616 and the second stage of the multi-stage compressor. The fluid flow is combined with a bypass flow that is received at bypass intake aperture 608 and travels into space 610 defined by inlet housing 606, where it enters channels 614 in impeller inlet duct body 612. The combined fluid flow and bypass flow continue to impeller 616.

Stage inlet 602 is defined by the inlet housing 606. The stage inlet 602 receives fluid discharged from the prior stage of a compressor including the assembled impeller duct and inlet housing 600 and directs it to flow straightener 604 of the impeller inlet duct. Flow straightener 604 may include a plurality of vanes to condition the flow of fluid passing through it. Flow straightener 604 may be flow straightener 202 shown in FIG. 2 and described above. The fluid flow through flow straightener 604 may enter an internal space defined by impeller inlet duct body 612. The internal space 700 can be seen in the sectional view provided in FIG. 7.

Inlet housing 606 also includes a body that forms a space 610 between the inner side of inlet housing 606 and the impeller inlet duct body 612. Inlet housing 606 may be the inlet housing 300 shown in FIG. 3 and described above. Inlet housing 606 includes a bypass intake aperture 608 that allows fluid from a bypass line to be introduced into space 610 within the inlet housing 606. In an embodiment, bypass intake aperture 608 receives fluid from a bypass line such as bypass line 116 shown in FIG. 1 and described above. In an embodiment, bypass intake aperture 608 receives fluid from a bypass line connected to compressor discharge ducting. In an embodiment, the fluid received at bypass intake aperture 608 may be controlled by a valve, such as valves 118 and 306 described above and shown in FIGS. 1 and 3, respectively. In an embodiment, the valve may be controlled based on unloading of the compressor and/or a detected or determined instability or stall in the compressor.

Channels 614 may allow flow of fluid from space 610 into impeller inlet duct body 612. Bypass flow may enter impeller inlet duct body 612 to join fluid from the prior stage of the multi-stage compressor that has passed through flow straightener 604. The channels 614 may be oriented to induce a swirl in the combined fluid flow as it continues to pass through the multi-stage compressor including the assembled impeller duct and inlet housing 600. The internal space 700 within impeller inlet duct body 612 and the orientation of channels 614 is shown in FIG. 7 and described below.

The combined fluid flow from the prior stage and the bypass then passes from within impeller inlet duct body 612 to impeller 616 and continues through the multi-stage compressor including the assembled impeller duct and inlet housing 600.

Figure 7:
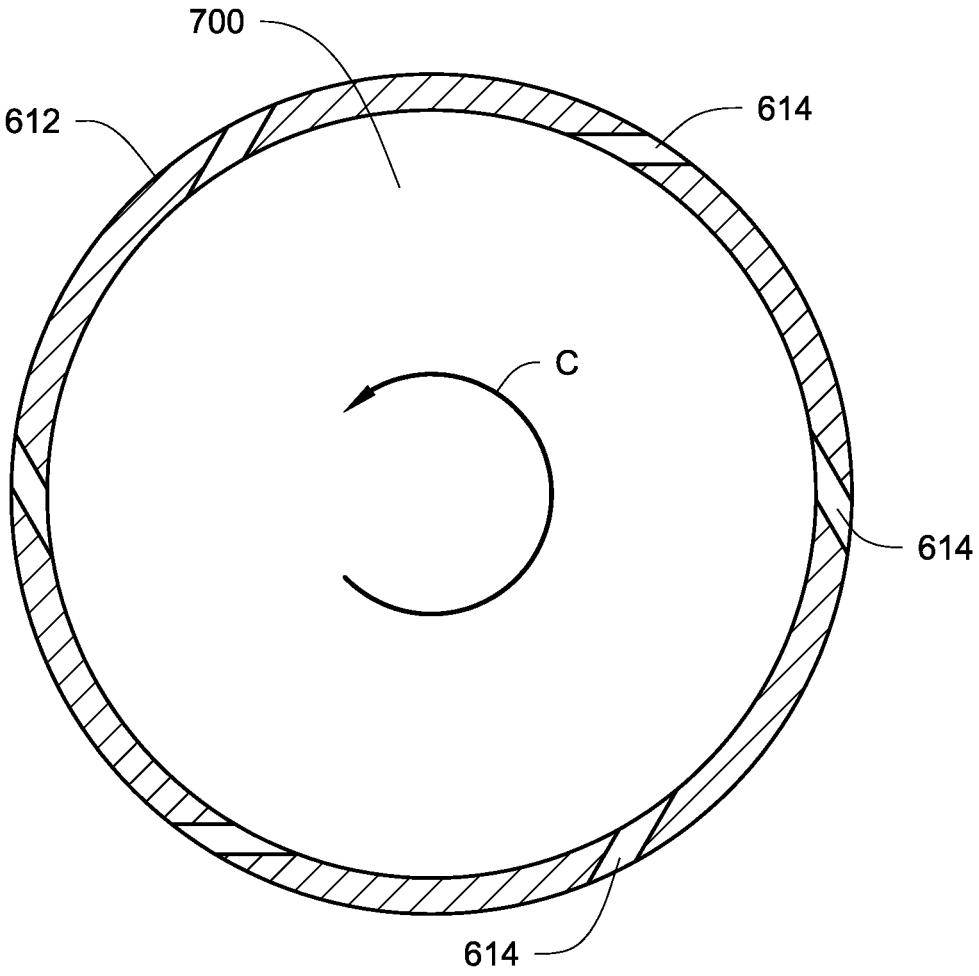
FIG. 7 is a sectional view taken across line A-A in FIG. 6.

FIG. 7 is a sectional view taken across line A-A in FIG. 6. In the sectional view of FIG. 7, internal space 700 is visible, defined by impeller inlet duct body 612. Internal space 700 receives fluid from prior stage discharge of the compressor via flow straightener 604. The direction of channels 614 as they pass through impeller inlet duct body 612 is visible. The direction of rotation of a compressor receiving fluid from the internal space 700 is shown by arrow C. Channels 614 are oriented such that the velocity of the fluid flow introduced by those channels 614 has a component in a direction tangential to the direction of flow of the fluid from the flow straightener 604, which may be flowing into the page in the sectional view of FIG. 7. The tangential component of the velocity of the fluid flow introduced by channels 614 may induce a swirl in the combined fluid flow through internal space 700. The swirl induced in the combined flows through internal space 700 may be in the same direction as the direction C of the rotation of the compressor receiving the combined fluid flow.

ASPECTS

It is understood that any of aspects 1-9 can be combined with any of aspects 10-13 or 14-19, and that any of aspects 10-13 may be combined with any of aspects 14-19.

Aspect 1: A heating, ventilation, air conditioning and refrigeration (HVACR) system, comprising:

a multi-stage compressor including a first stage discharge and a second stage inlet receiving fluid from the first stage discharge;

a condenser;

an expansion device;

an evaporator; and a bypass line from the condenser to the second stage inlet of the multi-stage compressor, the bypass line including a valve, wherein when the valve is open, the second stage inlet receives a fluid flow, and the second stage inlet is configured to direct the fluid flow to join the fluid from the first stage discharge such that a swirl is formed in a combined fluid flow.

Aspect 2: The HVACR system according to aspect 1, wherein the swirl is in a direction that is the same as a direction of rotation of an impeller in the multi-stage compressor.

Aspect 3: The HVACR system according to any of aspects 1-2, wherein the second stage inlet is further configured to direct the fluid flow in a direction having a component opposite a direction of flow of the fluid from the first stage discharge.

Aspect 4: The HVACR system according to any of aspects 1-2, wherein the second stage inlet is further configured to direct the fluid flow in a direction having a component is the same as a direction of flow of the fluid from the first stage discharge.

Aspect 5: The HVACR system according to any of aspects 1-4, wherein the second stage inlet is further configured to direct the fluid flow in a direction having a component in a direction that is tangential to a direction of flow of the fluid from the first stage discharge.

Aspect 6: The HVACR system according to any of aspects 1-5, wherein the valve is a variable flow rate valve.

Aspect 7: The HVACR system according to any of aspects 1-6, wherein the valve is opened when the multi-stage compressor is unloaded.

Aspect 8: The HVACR system according to any of aspects 1-7, wherein the second stage inlet does not include movable guide vanes.

Aspect 9: The HVACR system according to any of aspects 1-7, wherein the multi-stage compressor further comprises a first stage suction and a plurality of movable guide vanes at the first stage suction, wherein the plurality of movable guide vanes control a mass flow rate into the multi-stage compressor.

Aspect 10: An inlet duct for a multi-stage compressor, comprising an inlet opening configured to receive a first fluid flow from a first stage of the multi-stage compressor, and a plurality of channels configured to receive a second fluid flow from a bypass line and introduce the second fluid flow into the first fluid flow such that a swirl is formed in the first fluid flow.

Aspect 11: The inlet duct according to aspect 10, wherein the swirl is in a direction that is the same as a direction of rotation of an impeller in the multi-stage compressor.

Aspect 12: The inlet duct according to any of aspects 10-11, wherein the channels are configured to introduce the second fluid flow into the first fluid flow in a direction having a component opposite a direction of the first fluid flow.

Aspect 13: The inlet duct according to any of aspects 10-12, wherein the channels are through holes drilled from an exterior surface of the inlet duct to an interior space of the inlet duct, and wherein the interior space of the inlet duct receives the first fluid flow from the first stage of the multi-stage compressor via the inlet opening.

Aspect 14: A method for unloading a multi-stage compressor in a heating, ventilation, air conditioning, and refrigeration system, comprising:

receiving a first fluid flow from a first stage discharge of the multi-stage compressor, at a second-stage inlet of the multi-stage compressor;

opening a bypass valve in a bypass line, the bypass line connecting a condenser to the second-stage inlet; and directing a second fluid flow from the bypass line to join the first fluid flow through one or more channels in a duct of the second-stage inlet, such that a combined fluid flow has a swirl.

Aspect 15: The method according to aspect 14, wherein the swirl is in a direction that is the same as a direction of rotation of an impeller in the multi-stage compressor.

Aspect 16: The method according to any of aspects 14-15, wherein the second fluid flow travels in a direction having a component opposite a direction of the first fluid flow when the second fluid flow is directed to join the first fluid flow.

Aspect 17: The method according to any of aspects 14-15, wherein the second fluid flow travels in a direction having a component that is the same as a direction of the first fluid flow when the second fluid flow is directed to join the first fluid flow.

Aspect 18: The method according to any of aspects 14-17, wherein the second fluid flow travels in a direction having a component tangential to a direction of the first fluid flow when the second fluid flow is directed to join the first fluid flow.

Aspect 19: The method according to any of aspects 14-18, further comprising reducing a flow rate into a first stage of the multi-stage compressor using a plurality of movable guide vanes.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning and refrigeration (HVACR) system, comprising:

a multi-stage compressor including a first stage discharge and a second stage inlet receiving fluid from the first stage discharge;

a condenser;

an expansion device;

an evaporator; and a bypass line configured to convey fluid directly from the condenser to the second stage inlet of the multi-stage compressor, the bypass line including a valve, wherein when the valve is open, the second stage inlet receives a fluid flow, and the second stage inlet is configured to direct the fluid flow to join the fluid from the first stage discharge in a direction having a component that is the same as a direction of flow of the fluid from the first stage discharge, and when the fluid flow joins the fluid from the first stage discharge, a head pressure is boosted in a combined fluid flow prior to entering the second stage.

2. The HVACR system of claim 1, wherein the second stage inlet is further configured to direct the fluid flow in a direction having a component in a direction that is tangential to a direction of flow of the fluid from the first stage discharge.

3. The HVACR system of claim 1, wherein the valve is a variable flow rate valve.

4. The HVACR system of claim 1, wherein the valve is opened when the multi-stage compressor is unloaded.

5. The HVACR system of claim 1, wherein the second stage inlet does not include movable guide vanes.

6. The HVACR system of claim 1, wherein the multi-stage compressor further comprises a first stage suction and a plurality of movable guide vanes at the first stage suction, wherein the plurality of movable guide vanes control a mass flow rate into the multi-stage compressor.

7. The HVACR system of claim 1, wherein the second stage inlet is further configured to direct the fluid flow to join the fluid from the first stage discharge such that a swirl is formed in the combined fluid flow.

8. An inlet duct for a multi-stage compressor, comprising a flow straightener configured to receive a first fluid flow from a first stage of the multi-stage compressor, an outer wall defining an internal space, the outer wall extending from the flow straightener to an outlet, and a plurality of channels distributed around the outer wall, each extending through the outer wall to the internal space, the channels configured to receive a second fluid flow from a bypass line and introduce the second fluid flow into the first fluid flow in a direction having a component that is the same as a direction of the first fluid flow, and such that when the second fluid flow is introduced into the first fluid flow, a head pressure is boosted in a combined fluid flow, wherein the outlet is configured to provide the combined fluid flow to a second stage of the multi-stage compressor.

9. The inlet duct of claim 8, wherein the plurality of channels are configured such that a swirl is formed in the first fluid flow.

10. The inlet duct of claim 8, wherein the flow straightener includes a plurality of concentric circular openings connected by a plurality of vanes.

11. A method for unloading a multi-stage compressor in a heating, ventilation, air conditioning, and refrigeration system, comprising:

receiving a first fluid flow from a first stage discharge of the multi-stage compressor, at a second-stage inlet of the multi-stage compressor at a flow straightener of an inlet duct;

opening a bypass valve in a bypass line, the bypass line directly connecting a condenser to the second-stage inlet; and directing a second fluid flow from the bypass line to join the first fluid flow in the inlet duct, the second fluid flow being in a direction having a component that is the same as a direction of the first fluid flow when the second fluid flow is directed to join the first fluid flow, and when the second fluid flow joins the first fluid flow, a head pressure of a combined fluid flow is boosted.

12. The method of claim 11, wherein the second fluid flow travels in a direction having a component tangential to a direction of the first fluid flow when the second fluid flow is directed to join the first fluid flow.

13. The method of claim 11, further comprising reducing a flow rate into a first stage of the multi-stage compressor using a plurality of movable guide vanes.

14. The method of claim 11, wherein when the second fluid flow joins the first fluid flow, a swirl is induced in the combined fluid flow.

* * * * *